US008640612B2

(12) United States Patent
Yu Chen

(10) Patent No.: US 8,640,612 B2
(45) Date of Patent: Feb. 4, 2014

(54) PNEUMATIC PACKAGING APPARATUS

(76) Inventor: Hsiu-Man Yu Chen, Taichung (TW)

( * ) Notice: Subject to any disclaimer, the term of this patent is extended or adjusted under 35 U.S.C. 154(b) by 366 days.

(21) Appl. No.: 13/253,264

(22) Filed: Oct. 5, 2011

(65) Prior Publication Data

US 2013/0087053 A1 Apr. 11, 2013

(51) Int. Cl.
*B65B 13/18* (2006.01)

(52) U.S. Cl.
USPC ..... 100/29; 53/582; 53/590; 53/592; 100/30; 100/32; 100/33 PB; 156/350; 156/494; 156/495; 156/580

(58) Field of Classification Search
USPC ..... 53/582, 590, 592; 100/29, 30, 32, 100/33 PB; 156/350, 494, 495, 580
See application file for complete search history.

(56) References Cited

U.S. PATENT DOCUMENTS

| | | | | |
|---|---|---|---|---|
| 3,974,764 | A * | 8/1976 | Horton et al. | 100/269.16 |
| 5,689,943 | A * | 11/1997 | Wehr | 53/592 |
| 6,109,325 | A * | 8/2000 | Chang | 156/494 |
| 6,966,255 | B1 * | 11/2005 | Crittenden | 100/29 |
| 7,073,431 | B1 * | 7/2006 | Chen | 100/29 |
| 2004/0206251 | A1 * | 10/2004 | Nix | 100/29 |
| 2009/0277137 | A1 * | 11/2009 | May et al. | 53/465 |

* cited by examiner

*Primary Examiner* — Shelley Self
*Assistant Examiner* — Onekki Jolly
(74) *Attorney, Agent, or Firm* — Ming Chow; Sinorica, LLC

(57) ABSTRACT

A pneumatic packaging apparatus includes a fixed base provided thereon with a pressure cylinder unit connected with a chuck unit. The fixed base is further mounted with a valve seat combined thereon with a driving unit and a control unit. The control unit is able to receive external high pressure gas and control the high pressure gas to flow to the driving unit and to the pressure cylinder unit to let the driving unit and the pressure cylinder unit driven by air pressure to automatically pull tight the packaging strap and firmly squeeze the packaging fastener for fixing the packaging strap in place. Thus, the pneumatic packaging apparatus of this invention can assist users to complete packaging work with quickness, able to elevate efficiency of the packaging work.

5 Claims, 14 Drawing Sheets

PNEUMATIC PACKAGING APPARATUS

BACKGROUND OF THE INVENTION

1. Field of the Invention

This invention relates to a pneumatic packaging apparatus.

2. Description of the Prior Art

Generally, when transported, goods are usually tied up by means of packaging straps so as to prevent the goods from rocking and falling down on the way of transportation. When goods are to be tied up, a packaging strap is first wound around the peripheral side of the goods and two free ends of the packaging strap are oppositely inserted through a packaging fastener and secured on a packaging apparatus. Subsequently, the two free ends of the packaging strap will be oppositely moved forward by the packaging apparatus for pulling tight the packaging strap and then, the packaging fastener will be squeezed by the packaging apparatus for fixing the packaging strap in place, thus finishing binding the goods.

However, packaging apparatuses at the present time are mostly operated manually so it is necessary to take much time and physical strength for pulling tight the packaging strap. Thus, users doing such packaging work for a long period of time are apt to feel exhausted to lower efficiency of packaging work, and this situation will become even more apparent especially in transportation business that needs to carry out packaging work with a large quantity, always resulting in delay of goods transportation.

SUMMARY OF THE INVENTION

The objective of this invention is to offer a pneumatic packaging apparatus that makes use of high pressure gas as a power source for automatically pulling tight a packaging strap and firmly squeezing a packaging fastener to assist users to complete packaging work with quickness.

The pneumatic packaging apparatus in the present invention includes a fixed base provided with a base plate formed with a front end and an opposite rear end. The base plate has its topside longitudinally bored with at least one insert hole having at least one roller pivotally set in an interior and further has one side formed with a fixed block protruding upward vertically. A valve seat is pivotally disposed at one side of the fixing block, facing a rear end of the base plate, having an interior formed with a flow channel. The valve seat further has its outer peripheral side bored with an air intake, a first valve hole and a second valve hole respectively communicating with the flow channel, and also bored with a first exhaust hole communicating with the first valve hole, and a second exhaust hole communicating with the second valve hole. A control unit is provided with a first valve body received in the first valve hole and connected with a first press key for controlling the first valve body to open to let the first valve hole communicate with the first exhaust hole. The control unit is further provided with a second valve body positioned in the second valve hole and connected with a second press key for controlling the second valve body to open to let the second valve hole communicate with the second exhaust hole. A driving unit consists of a pneumatic motor that is secured on the valve seat and connected with the first exhaust hole and also formed with an output shaft having a worm fixed thereon. The driving unit is further provided with a driving shaft pivotally assembled on the valve seat, and disposed thereon with a worm wheel to be engaged with the worm and a driving wheel positioned on the roller. A pressure cylinder unit firmly installed at one side of the fixing block, facing a front end of the base plate, consists of a pressure cylinder body provided therein with an elastic sealing pad and having its interior formed with a first accommodating chamber and a second accommodating chamber. The pressure cylinder body has an outer circumferential side bored with a first insert hole communicating with both the first accommodating chamber and the second exhaust hole, and further has a circumferential side bored with a second insert hole communicating with the second accommodating chamber. A chuck unit has a press plate positioned in the second accommodating chamber and connected with a shaft rod, which has another end passed out of the second insert hole and pivotally connected with a pair of connecting rod. Two clamping levers are respectively and pivotally connected with another end of the pair of connecting rods, respectively having another end pivotally combined with a fixed plate that is secured with the fixed block of the fixed base, and further having their another ends oppositely cut with a clamping notch. The shaft rod is fitted thereon with at least one spring having two ends respectively pushing against the press plate and the inner wall of the second accommodating chamber.

To use the pneumatic packaging apparatus of this invention, firstly, have two ends of a packaging strap oppositely inserted through a packaging fastener to be overlapped on the base plate and positioned between the roller and the driving wheel. Next, press down the first press key to open the first valve body to let external high pressure gas flow into the pneumatic motor through the air intake to enable the pneumatic motor to drive the driving wheel to rotate for actuating the two ends of the packaging strap to be moved oppositely and pulled tight. Afterward, press down the second press key to open the second valve body to let external high pressure gas flow into the pressure cylinder unit to enable the pressure cylinder unit to actuate the chuck unit to clamp the packaging fastener, letting the packaging fastener firmly squeezed on the packaging strap. Thus, the pneumatic packaging apparatus of this invention can automatically pull tight and firmly fix the packaging strap in place, able to assist users to quickly complete packaging work for enhancing efficiency of the packaging work.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
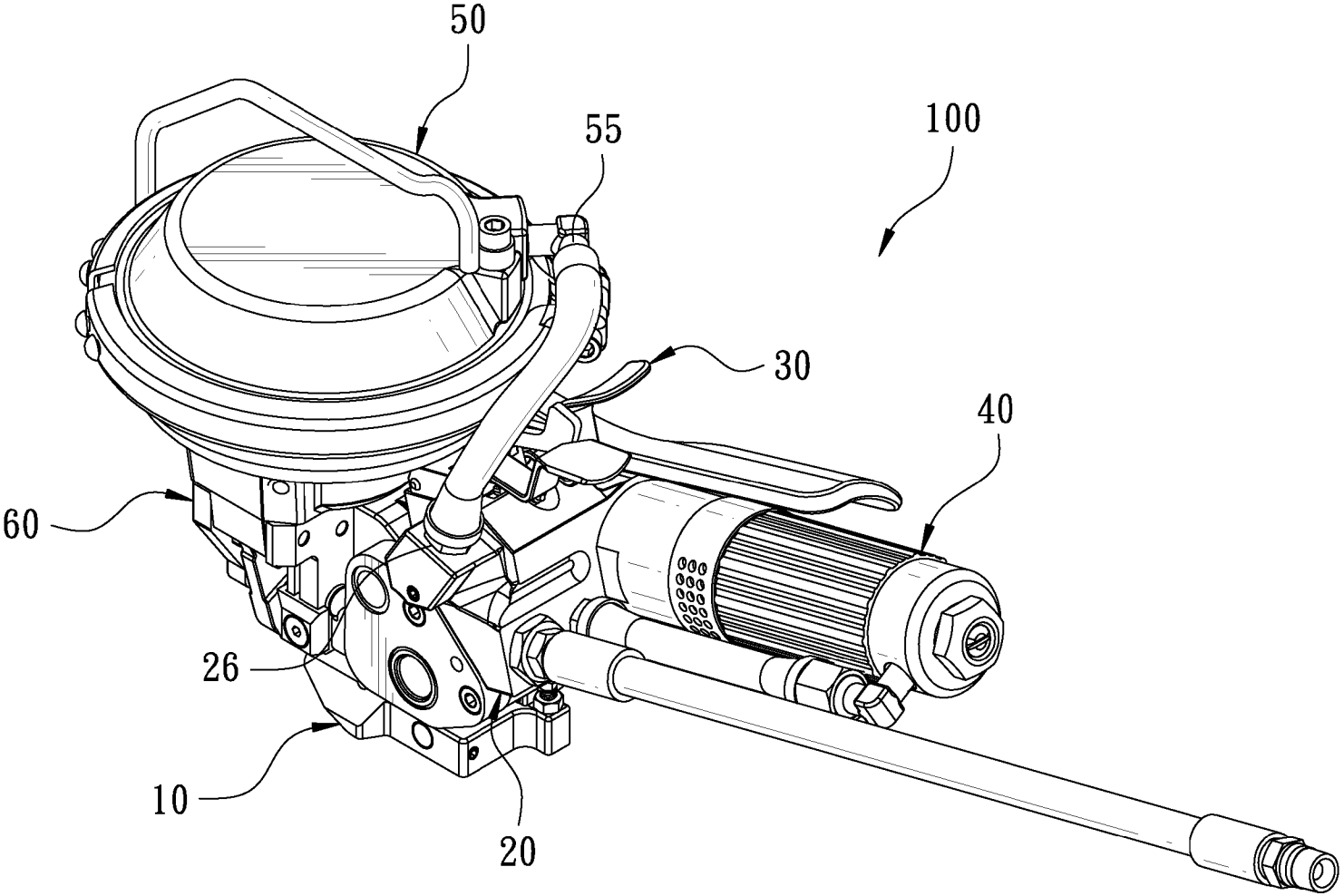
FIG. 1 is a perspective view of a pneumatic packaging apparatus in the present invention.
Figure 2:
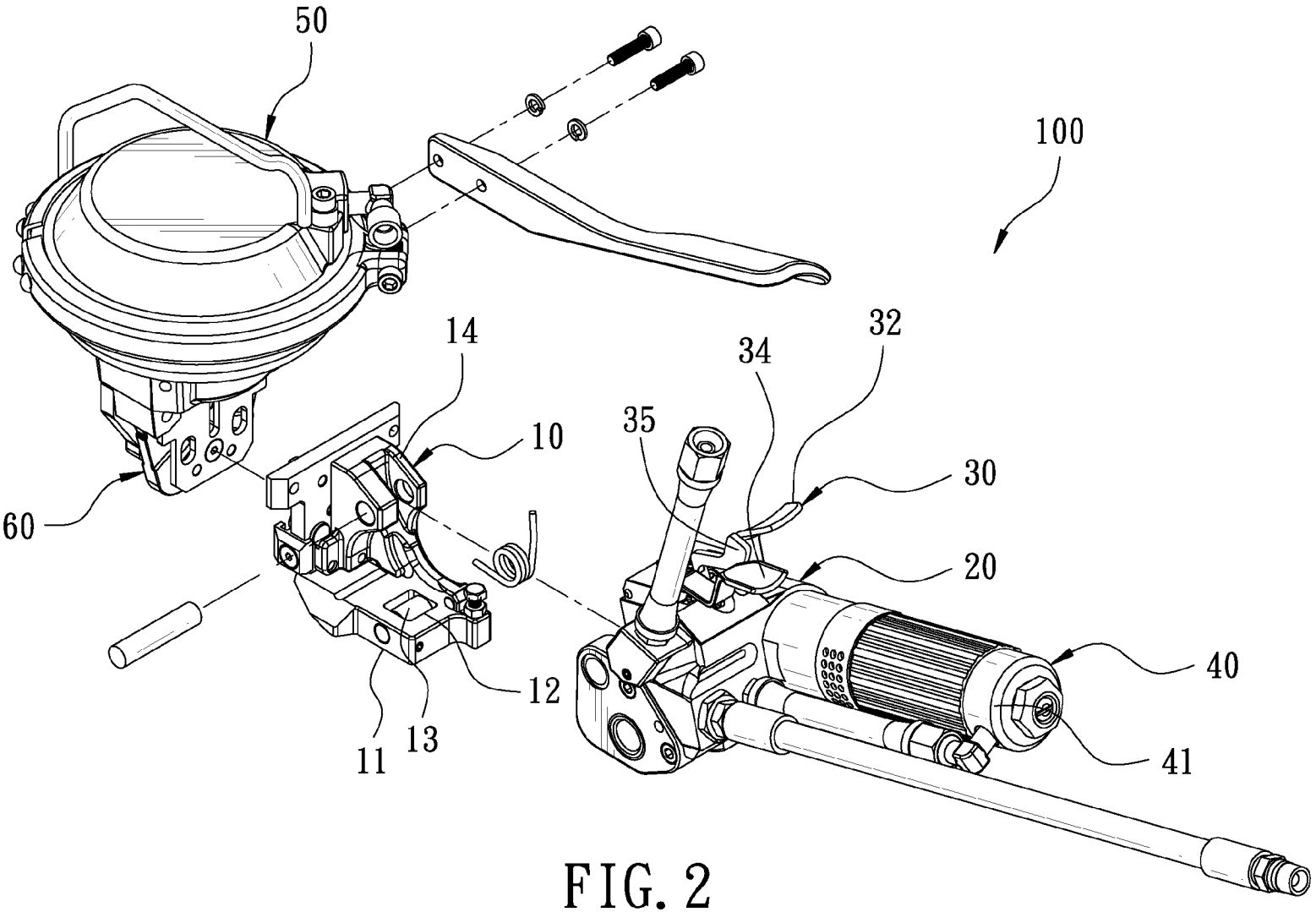
FIG. 2 is a partial exploded perspective view of the pneumatic packaging apparatus in the present invention.
Figure 3:
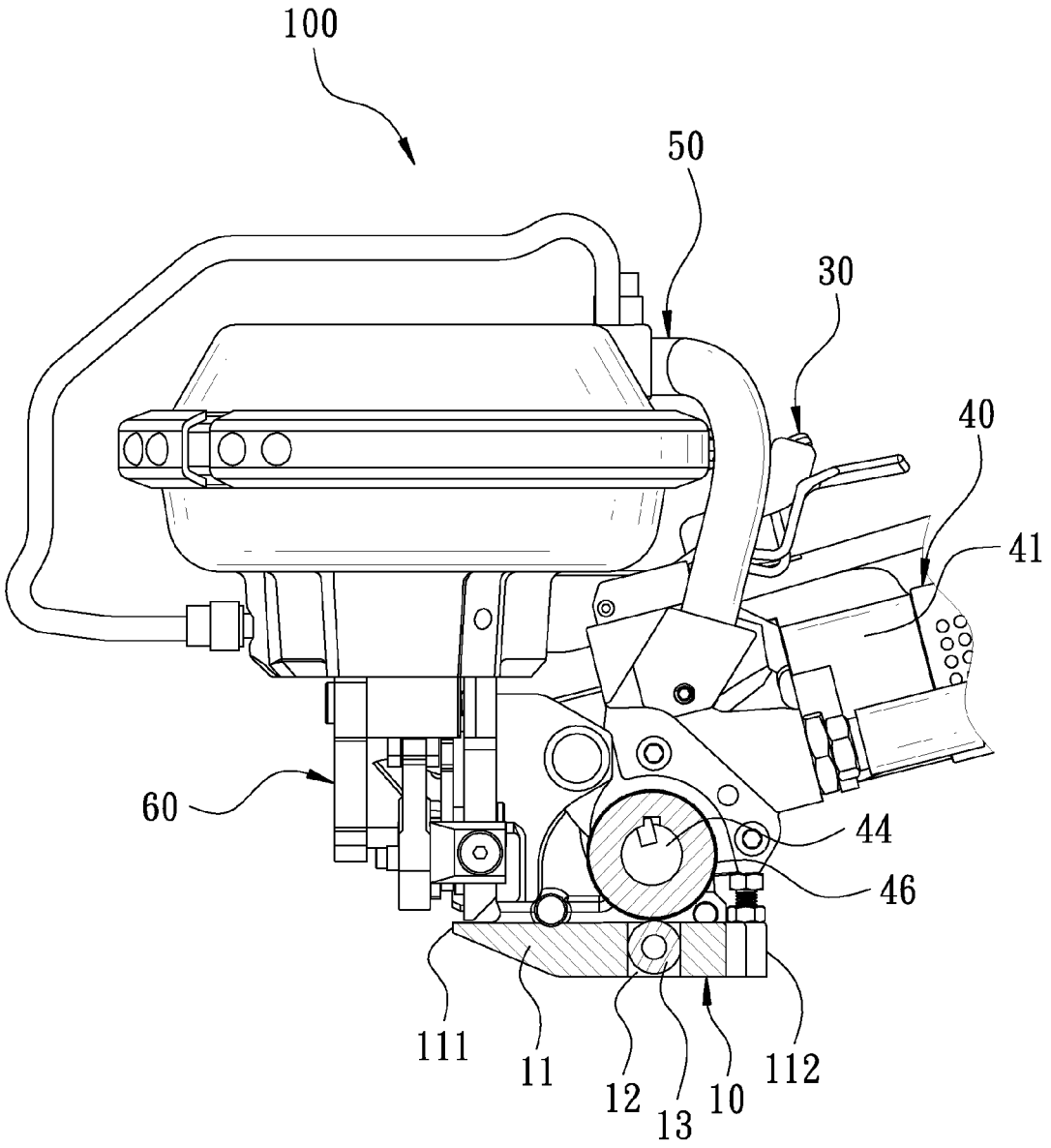
FIG. 3 is a partial cross-sectional view of the pneumatic packaging apparatus in the present invention.
Figure 4:
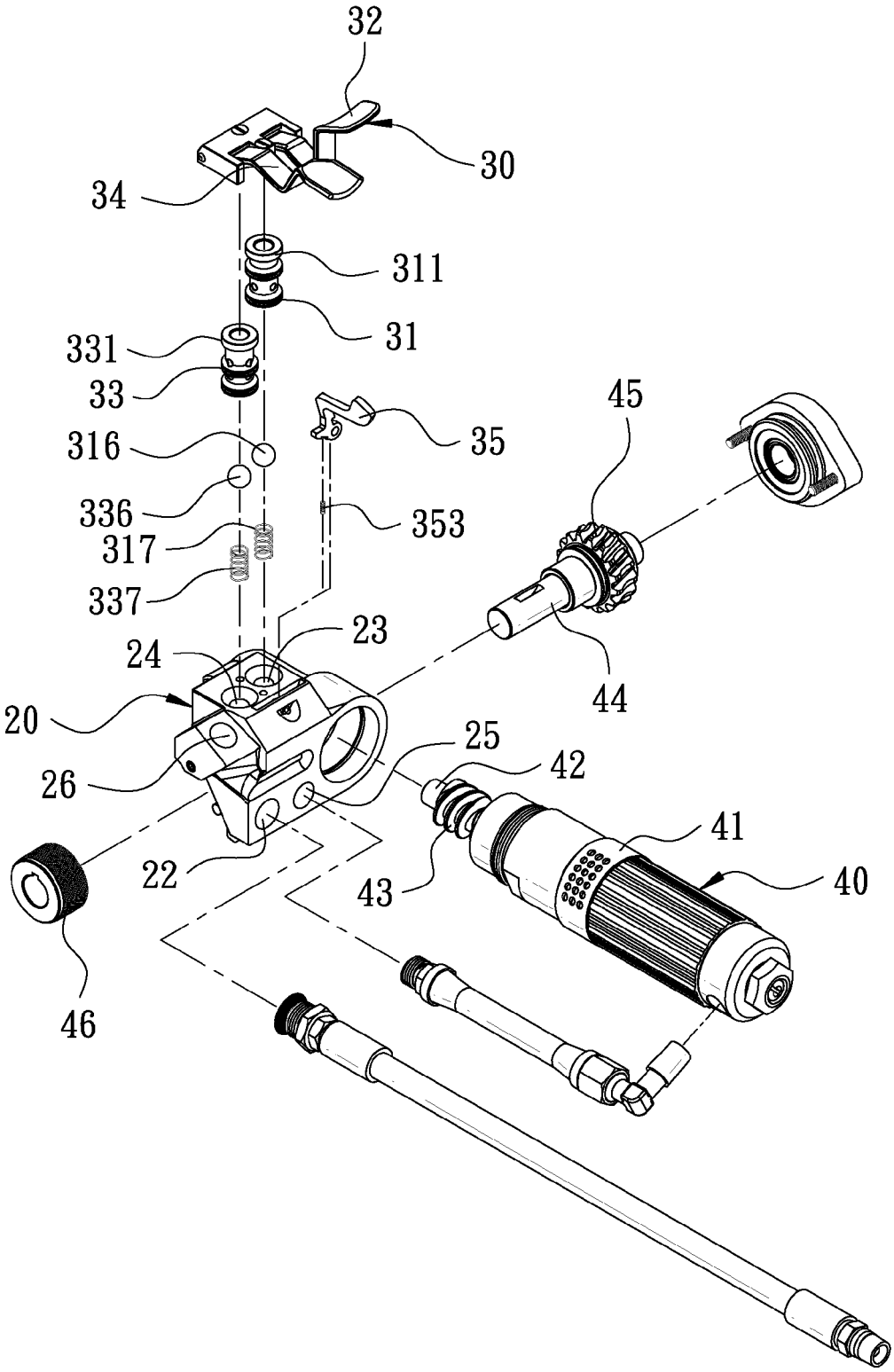
FIG. 4 is a partial exploded perspective view of members to be combined with a valve seat of the pneumatic packaging apparatus in the present invention.
Figure 5:
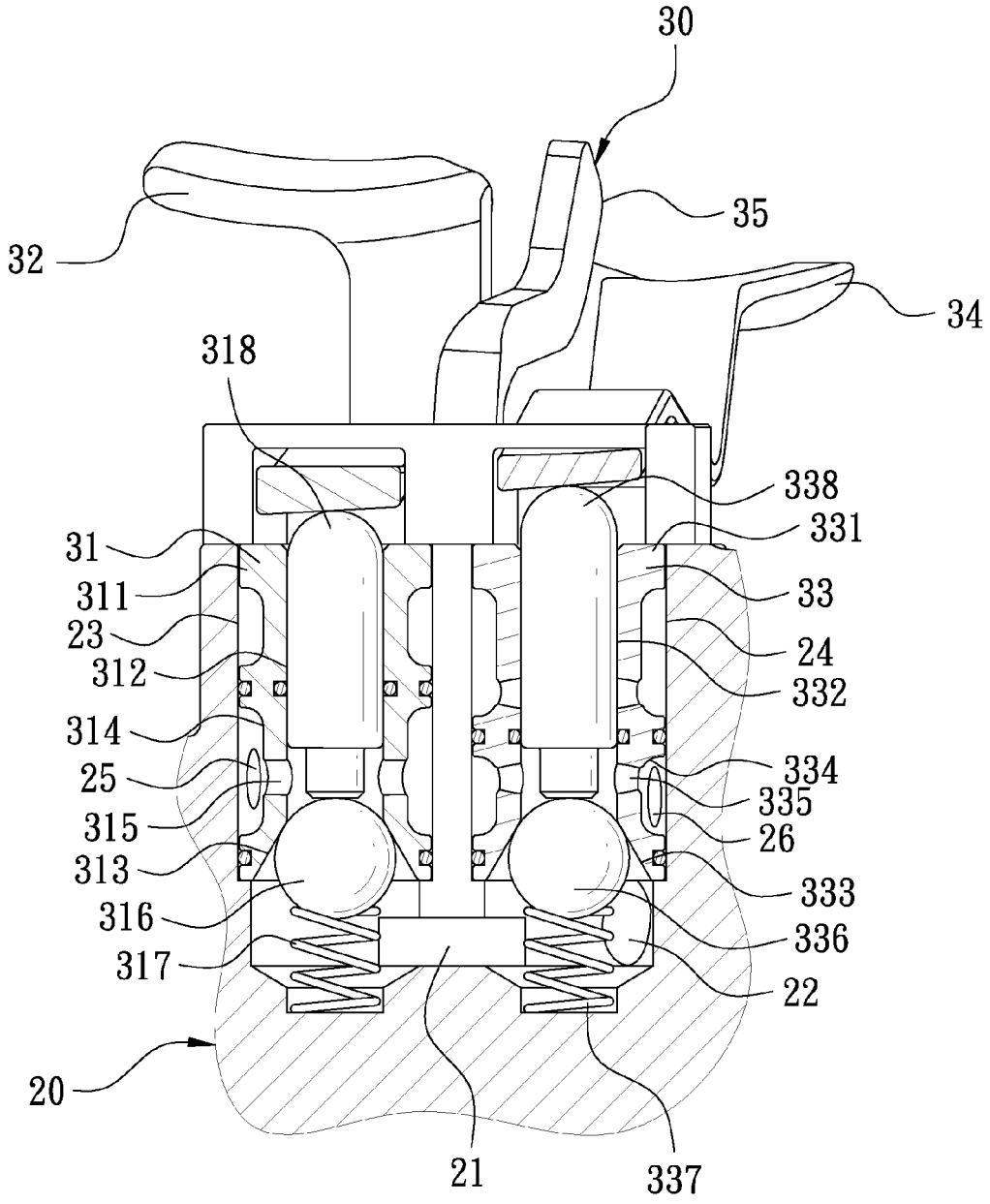
FIG. 5 is a partial magnified cross-sectional view of the members combined with the valve seat of the pneumatic packaging apparatus in the present invention.
Figure 6:
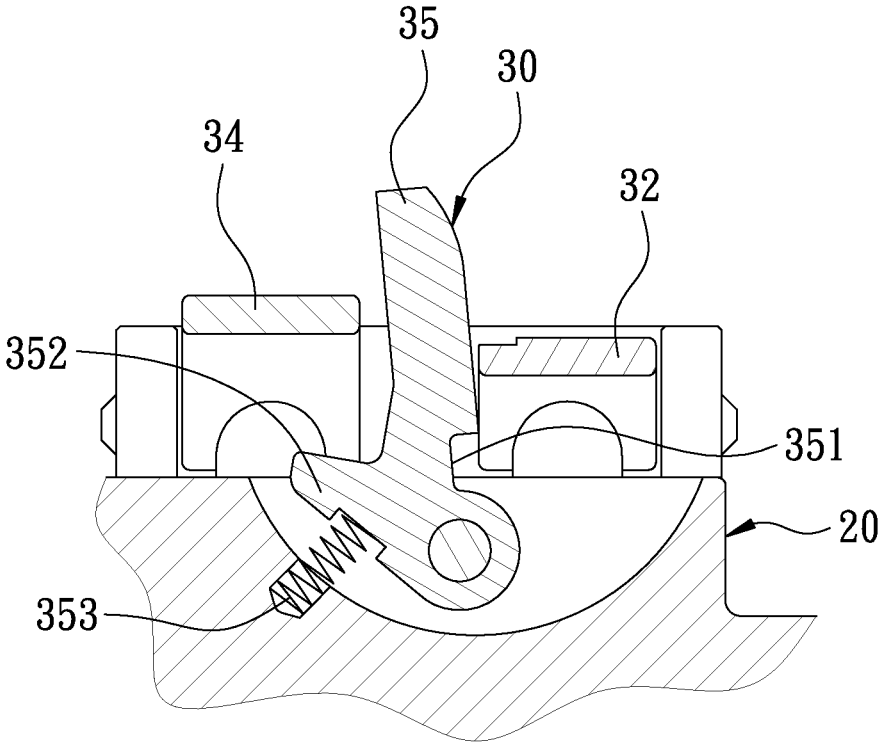
FIG. 6 is a partial magnified cross-sectional view of a control unit of the pneumatic packaging apparatus in the present invention.
Figure 7:
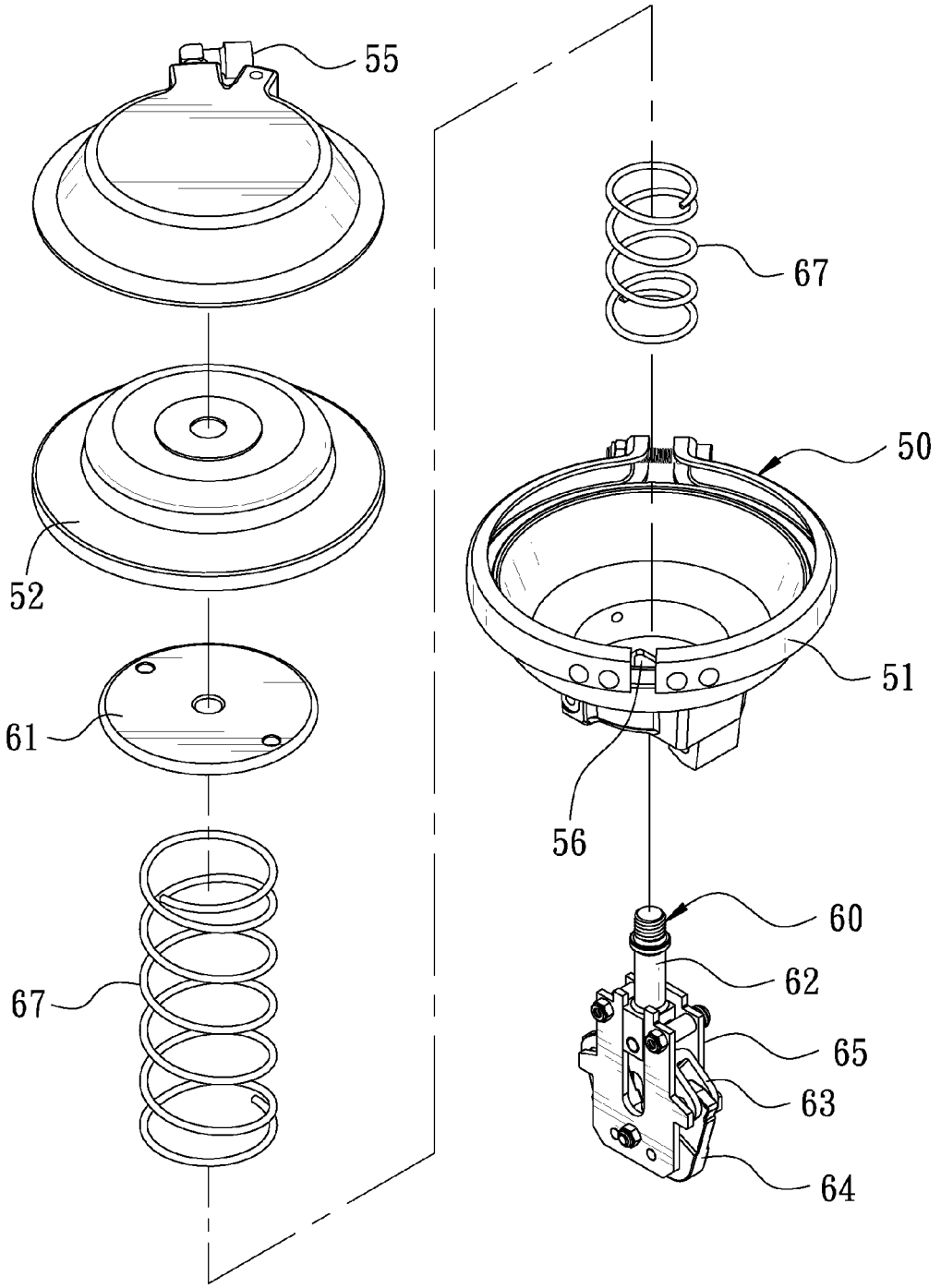
FIG. 7 is an exploded perspective view of a pressure cylinder unit of the pneumatic packaging apparatus in the present invention.
Figure 8:
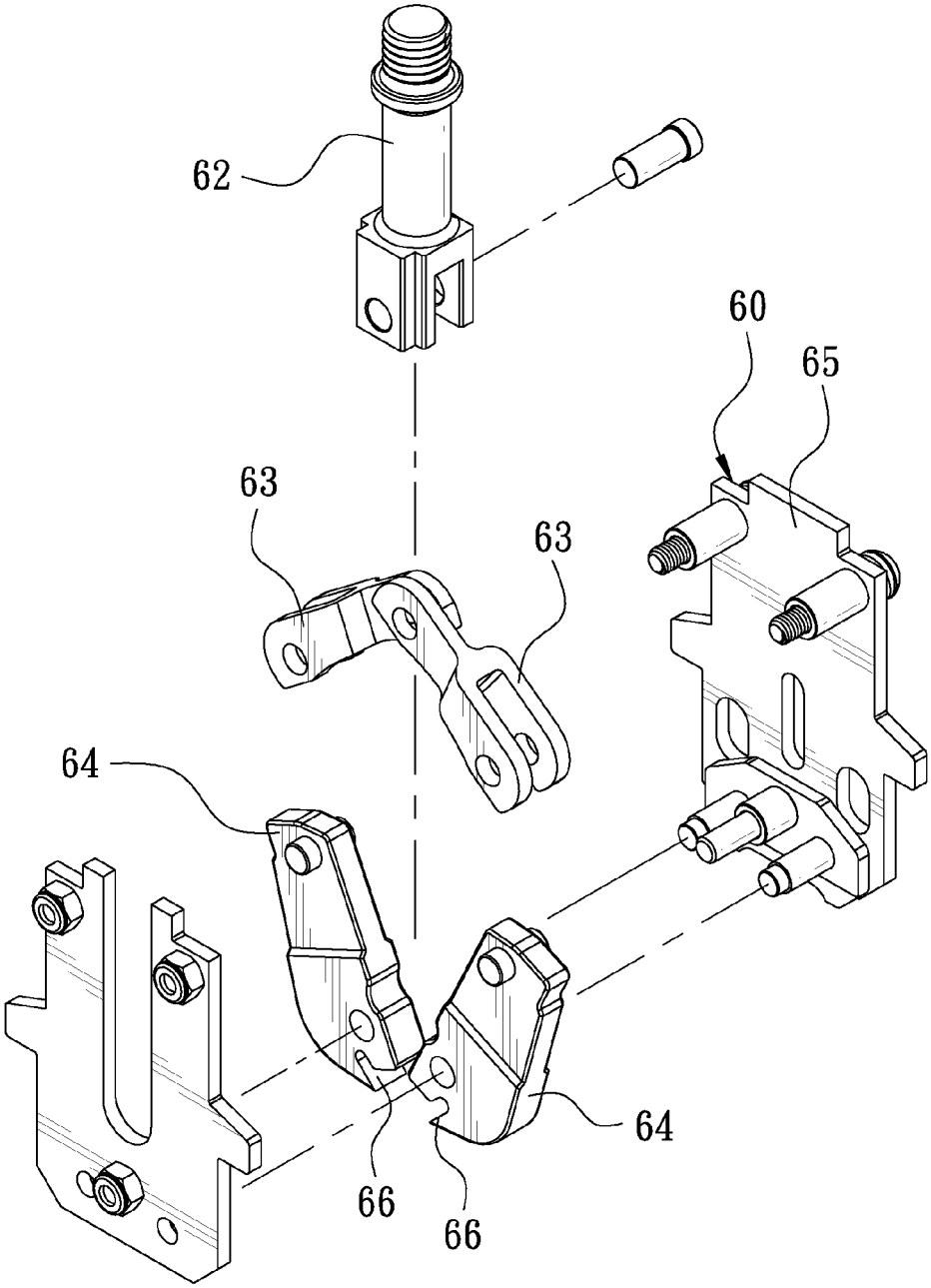
FIG. 8 is an exploded perspective view of a chuck unit of the pneumatic packaging apparatus in the present invention.

A preferred embodiment of a pneumatic packaging apparatus 100 in the present invention, as shown in FIGS. 1-8, includes a fixed base 10, a valve seat 20. a control unit 30. a driving unit 40, a pressure cylinder unit 50 and a chuck unit 60 as main components combined together.

The fixed base 10 is provided with a base plate 11 formed with a front end 111 and an opposite rear end 112 and having its topside longitudinally bored with at least one insert hole 12 having at least one roller 13 pivotally assembled therein. In this preferred embodiment, the base plate 11 is longitudinally bored with one insert hole 12 pivotally set therein with one roller 13 that is shaped as a column, whose pivot is perpendicular to the lengthwise side of the base plate 11. Further, the base plate 11 of the fixed base 10 has one side provided with a fixed block 14 protruding up vertically.

The valve seat 20 is pivotally mounted at one side of the fixing block 14, facing the rear end 112 of the base plate 11, and has an interior disposed with a flow channel 21 and an outer peripheral side bored with an air intake 22, a first valve hole 23 and a second valve hole 24 respectively communicating with the flow channel 21, and further bored with a first exhaust hole 25 communicating with the first valve hole 23, and a second exhaust hole 26 communicating with the second valve hole 24.

The control unit 30 is provided with a first valve body 31 received in the first valve hole 24 and connected with a first press key 32 that controls the first valve body 31 to open to enable the first valve hole 23 to communicate with the first exhaust hole 25. The first valve body 31 is provided with a support member 311 fixed in the first valve hole 23 and axially bored with a shaft hole 312 having a flaring opening 313 adjacent to one end of the flow channel 21. Further, the support member 311 has an outer circumferential side annularly cut with an annular groove 314 at a location corresponding with the first exhaust hole 25, and the annular groove 314 has its bottom wall bored with a plurality of through holes 315 communicating with the shaft hole 312. A steel ball 316 is positioned in the flaring opening 313 and connected with a spring 317 having another end secured at the inner wall of the flow channel 21. A valve rod 318 is slidably assembled in the shaft hole 312, having one end protruding out of the shaft hole 312 to push against the first press key 32 and another end resisting against the steel ball 316. The control unit 30 is further provided with a second valve body 33 received in the second valve hole 24 and connected with a second press key 34 for controlling the second valve body 33 to open to let both the second valve hole 24 and the second exhaust hole 26 communicate with each other. The second valve body 33 is provided with a support member 331 fixed in the second valve hole 24 and axially disposed with a shaft hole 332 formed with a flaring opening 333 adjacent to one end of the flow channel 21. The support member 331 has an outer circumferential side annularly cut with a annular groove 334 at a location corresponding with the second exhaust hole 26, and the bottom wall of the annular groove 334 is bored with a plurality of through holes 335 communicating with the shaft hole 332. A steel ball 336 is positioned at the flaring opening 333 and connected with a spring 337, which has another end secured at the inner wall of the flow channel 21. A valve rod 338 is slidably received in the shaft hole 332, having one end protruding out of the shaft hole 332 and pushing against the second press key 34 and another end resisting against the steel ball 336. In addition, the control unit 30 has an elastic restraining member 35 provided between the first press key 32 and the second press key 34, and the elastic restraining member 35 has one end pivotally connected with the valve seat 20 and another end being a free end, and further has a peripheral side cut with a recessed groove 351 corresponding with the first press key 32 and has another peripheral side provided with a protruding block 352 corresponding with the second press key 34. The protruding block 352 is connected with a spring 353 having another end connected with the valve seat 20, letting the elastic restraining member 35 possess a prestress to sway bias toward the first press key 32.

The driving unit 40 has a pneumatic motor 41 fixed on the valve seat 20 and connected with the first exhaust hole 25, and the pneumatic motor 41 is formed with an output shaft 42 provided thereon with a worm 43. The driving unit 40 is further provided with a driving shaft 44 pivotally assembled on the valve seat 20 and set thereon with a worm wheel 45 to be engaged with the worm 43, and the driving shaft 44 is further provided with a driving wheel 46 located on the roller 13.

Figure 13:
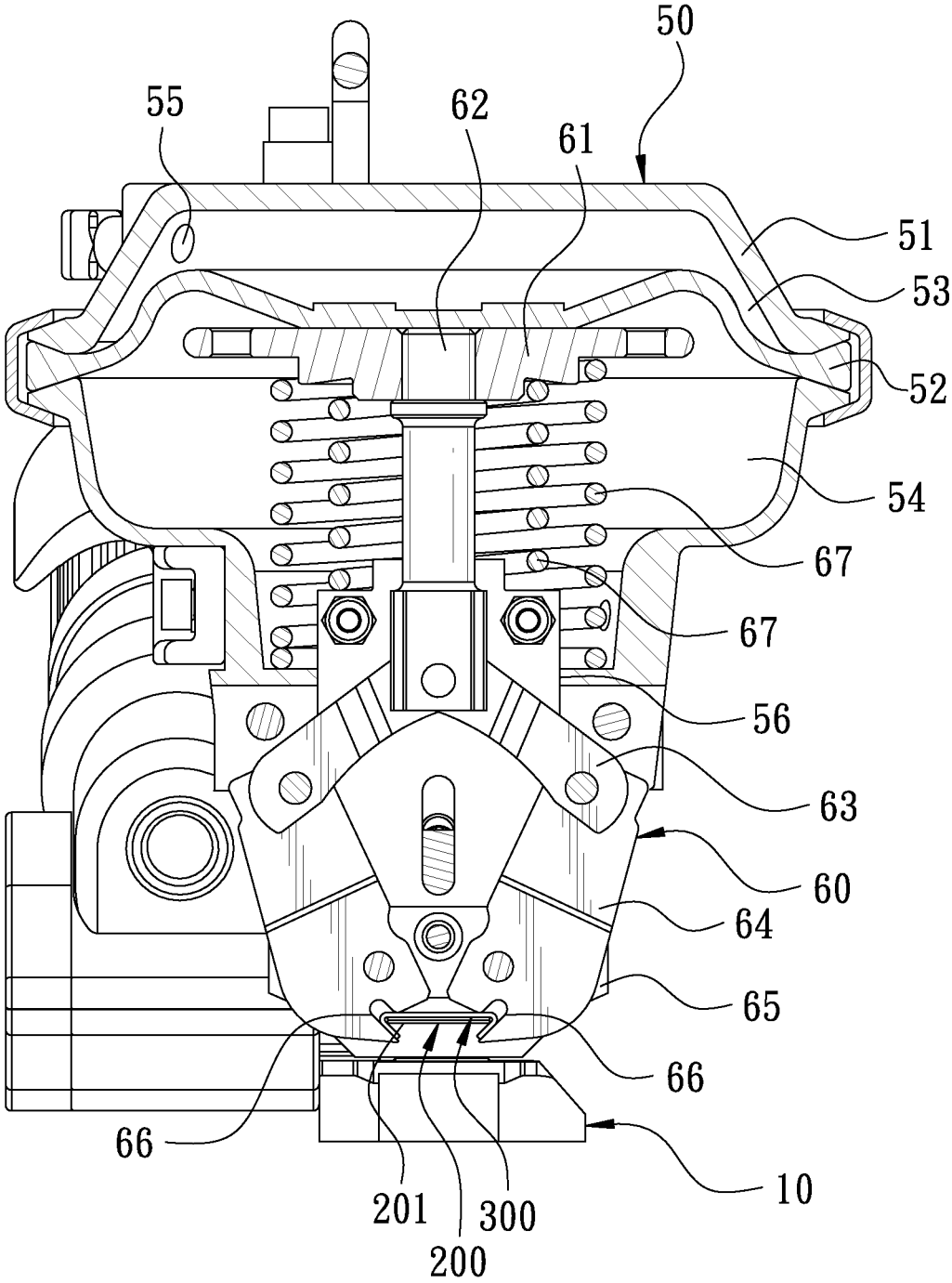
FIG. 13 is a partial cross-sectional view of the pneumatic packaging apparatus in a using condition in the present invention, illustrating that the chuck unit is in a clamping state.

The pressure cylinder unit 50 to be firmly installed at one side of the fixing block 14, facing the front end 111, provided with a pressure cylinder body 51 having an elastic sealing pad 52 positioned in an interior. The pressure cylinder body 51 has an interior formed with a first accommodating chamber 53 and a second accommodating chamber 54, as shown in FIG. 13. Moreover, the pressure cylinder 51 has its outer circumferential side bored with a first insert hole 55 communicating with both the first accommodating chamber 53 and the second exhaust hole 26, as shown in FIG. 1, and also bored with a second insert hole 56 communicating with the second accommodating chamber 54.

The chuck unit 60 has a press plate 61 received in the second accommodating chamber 54 and connected with a shaft rod 62, which has another end passed out of the second insert hole 56 and pivotally connected with a pair of connecting rods 63. Two clamping levers 64 are respectively and pivotally connected with another end of the pair of connecting rods 63, respectively having another end pivotally connected with a fixed plate 65 that is secured with the fixed block 14 of the fixed base 10. Furthermore, the two clamping levers 64 respectively have another ends oppositely cut with a clamping notch 66, and at least one spring 67 is fitted around the shaft rod 62, having two ends respectively pushing against the press plate 61 and the inner wall of the second accommodating chamber 54.

Figure 9:
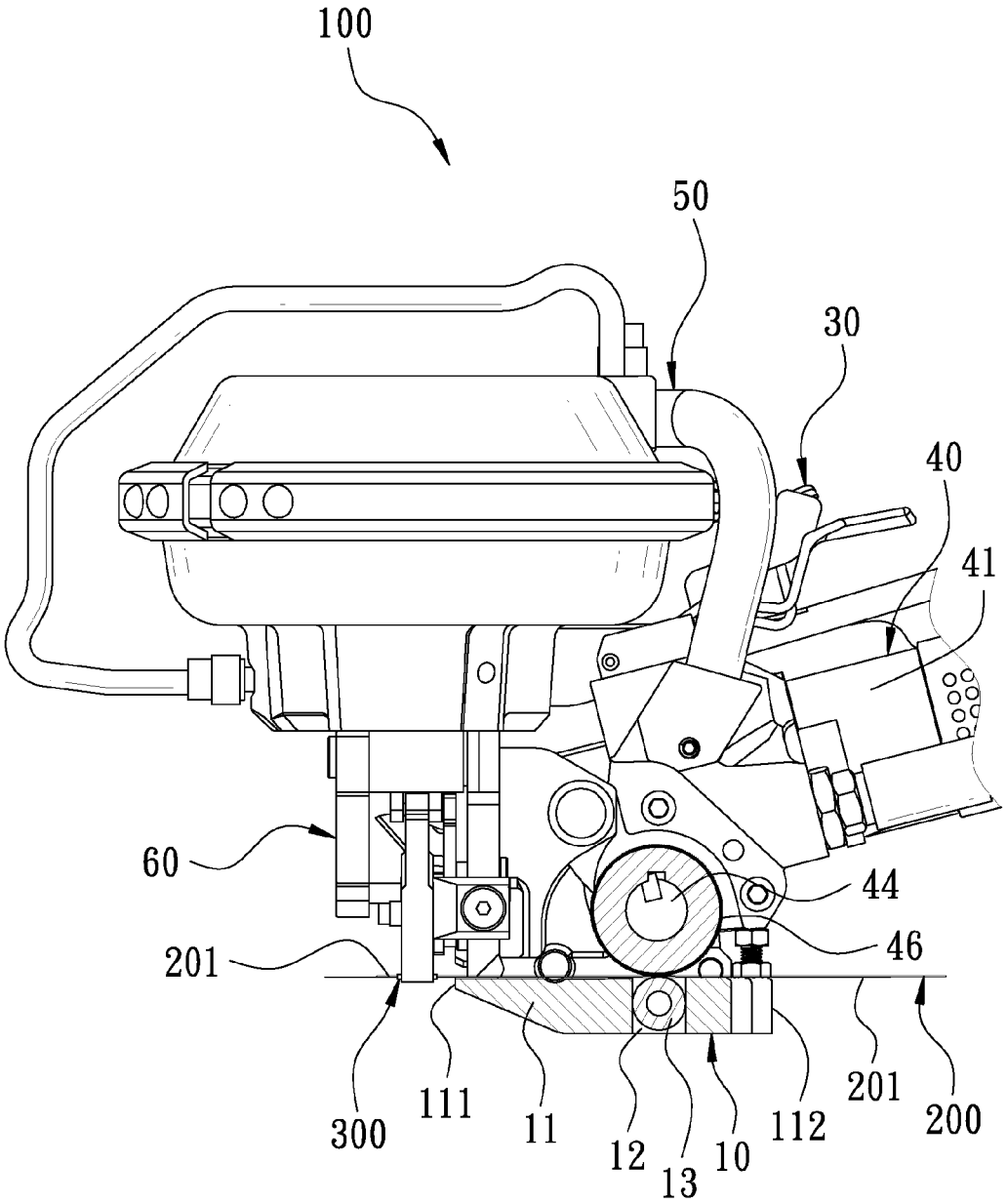
FIG. 9 is a cross-sectional view of the pneumatic packaging apparatus in a using condition in the present invention, illustrating that a packaging strap is inserted in the apparatus for use.
Figure 10:
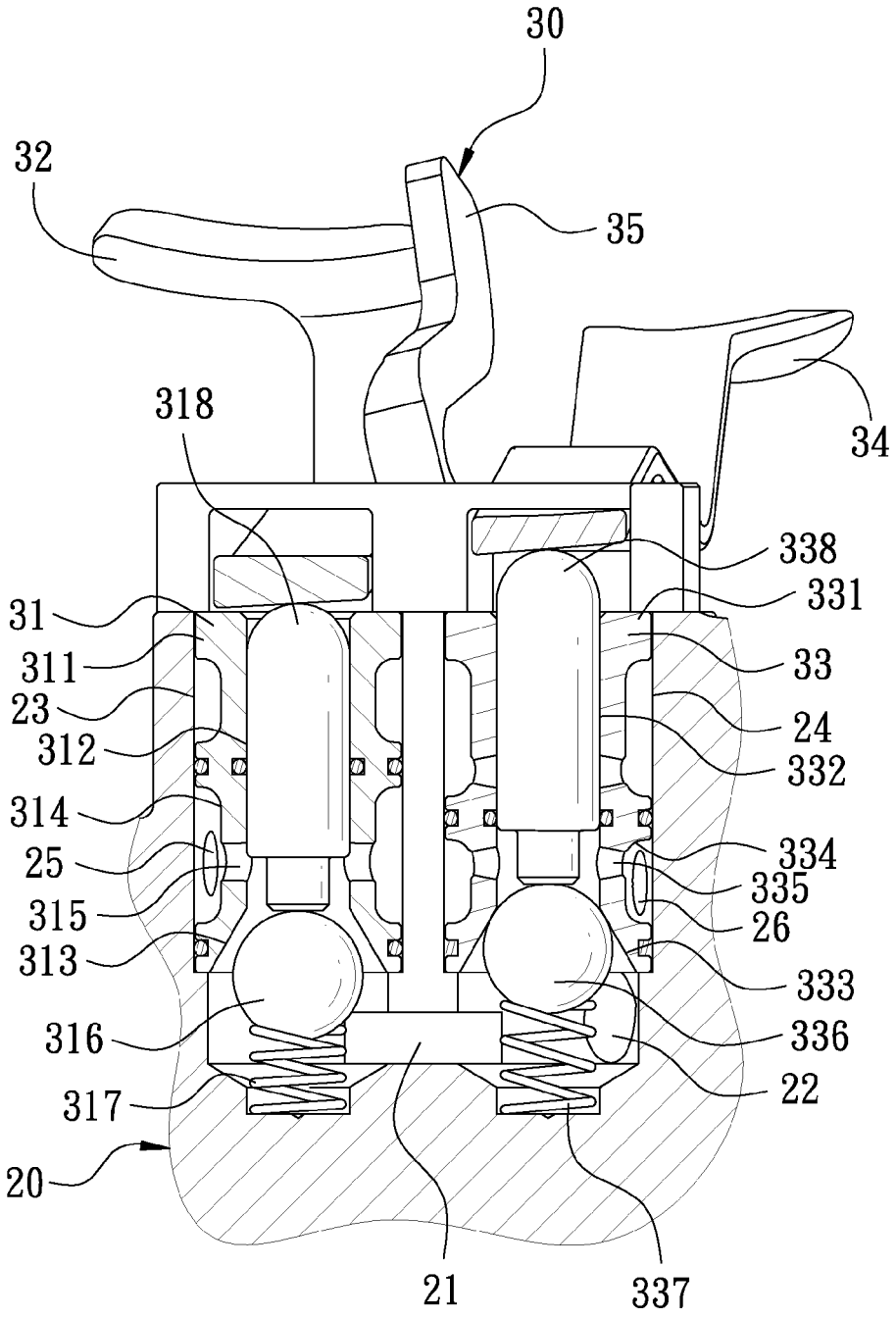
FIG. 10 is a partial cross-sectional view of the pneumatic packaging apparatus in a using condition in the present invention, illustrating a state after a first press key is pressed down.
Figure 11:
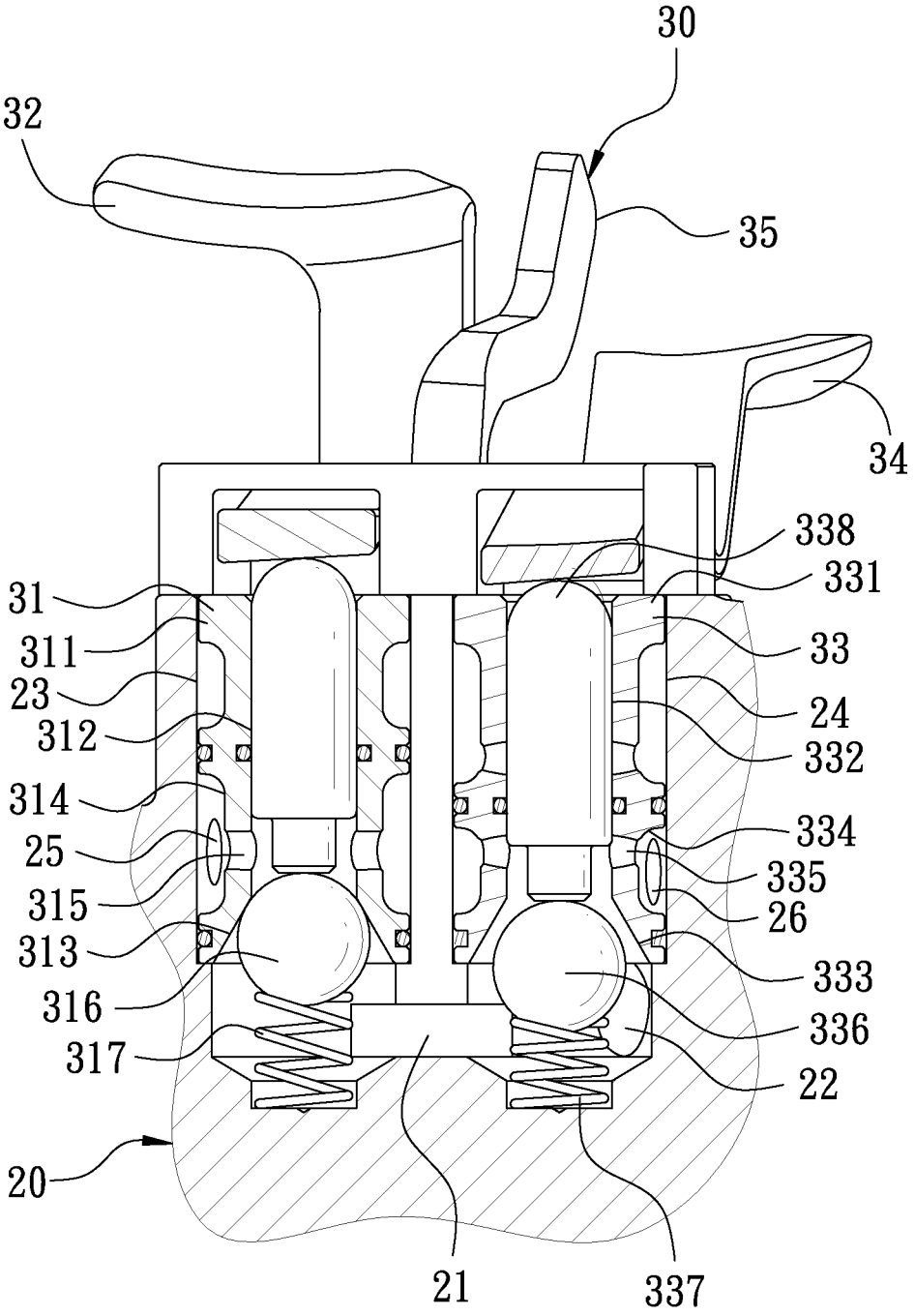
FIG. 11 is a partial cross-sectional view of the pneumatic packaging apparatus in a using condition in the present invention, illustrating a state after a second press key is pressed down.
Figure 12:
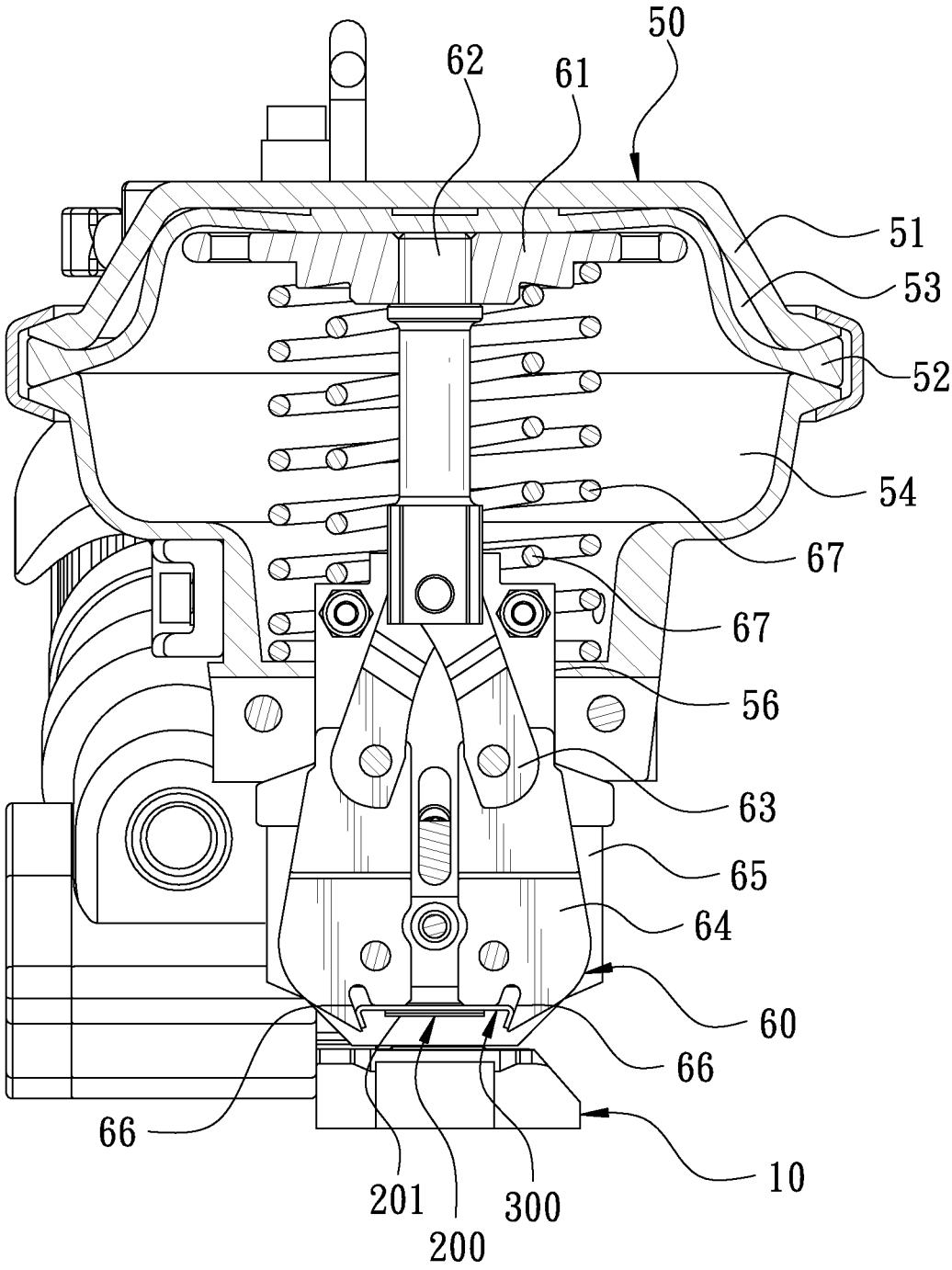
FIG. 12 is a partial cross-sectional view of the pneumatic packaging apparatus in a using condition in the present invention, illustrating that a chuck unit is in a released state.

Referring to FIGS. 9-13, to employ the pneumatic packaging apparatus 100 of this invention, firstly, have the air intake 22 of the pneumatic packaging apparatus 100 connected to an external air supply machine (not shown) and then, have a packaging strap 200 bound around goods (not shown) and have two free ends 201 of the packaging strap 200 oppositely inserted through a packaging fastener 300 to be overlapped on the base plate 11 of the pneumatic packaging apparatus 100 and positioned between the roller 13 and the driving wheel 46. Next, start the pneumatic packaging apparatus 100 to actuate the external air supply machine to pump high pressure gas into the flow channel 21 through the air intake 22 and at this time, only push down the first press key 32 to force the valve rod 318 of the valve body 31 to move downward and push the steel ball 316 to move away from the flaring opening 313, as shown in FIG. 10, to enable the high pressure gas to get into the first exhaust hole 25 through the flaring opening 313 and the through hole 315. Simultaneously, the high pressure gas will get to the pneumatic motor 41 to drive the pneumatic motor 41 to start operating and have the worm 43 actuating the worm wheel 45 together with the driving shaft 44 to rotate and meanwhile, as shown in FIG. 9, the driving wheel 46 will actuate the two free ends 201 of the packaging strap 200 to move oppositely, thus able to pull tight the packaging strap 200. Lastly, as shown in FIG. 11, press down the second press key 34 to drive the valve rod 338 of the second valve body 33 to push the steel ball 336 to move away from the flaring opening 333 to enable high pressure gas to get into the second exhaust hole 26 through the flaring opening 333 and the through hole 335.Then as shown in FIG. 12, simultaneously, the high pressure gas will get into the first accommodating chamber 53 of the pressure cylinder body 51 through the first insert hole 55 to inflate the first accommodating chamber 53. At this time, as shown in FIG. 13 air pressure in the first accommodating chamber 53 will drive the press plate 61 to move toward the second insert hole 56 to have the shaft rod 62 actuating the pair of connecting rods 63 to tug the two clamping levers 64 to turn oppositely and have their clamping notches 66 firmly clamping the packaging fastener 300 to let the packaging fastener 300 firmly squeezed on and fix the packaging strap 200 in place. By so designing, the pneumatic packaging apparatus 100 of this invention can automatically tighten the packaging strap 200 and firmly squeeze the fastener 300 for stabilizing the packaging strap 200, able to assist users to complete packaging work with quickness and with high efficiency.

Referring to FIG. 9, one feature of this invention is that the base plate 11 has a topside pivotally provided with the roller 13 whose pivot is perpendicular to the lengthwise side of the base plate 11; therefore, when the pneumatic packaging apparatus 100 is operated to pull tight the packaging strap 200, the roller 13 will be able to reduce the frictional force between the packaging strap 200 and the base plate 11 to enable two free ends 201 of the packaging strap 200 to move oppositely with great smoothness.

Figure 14:
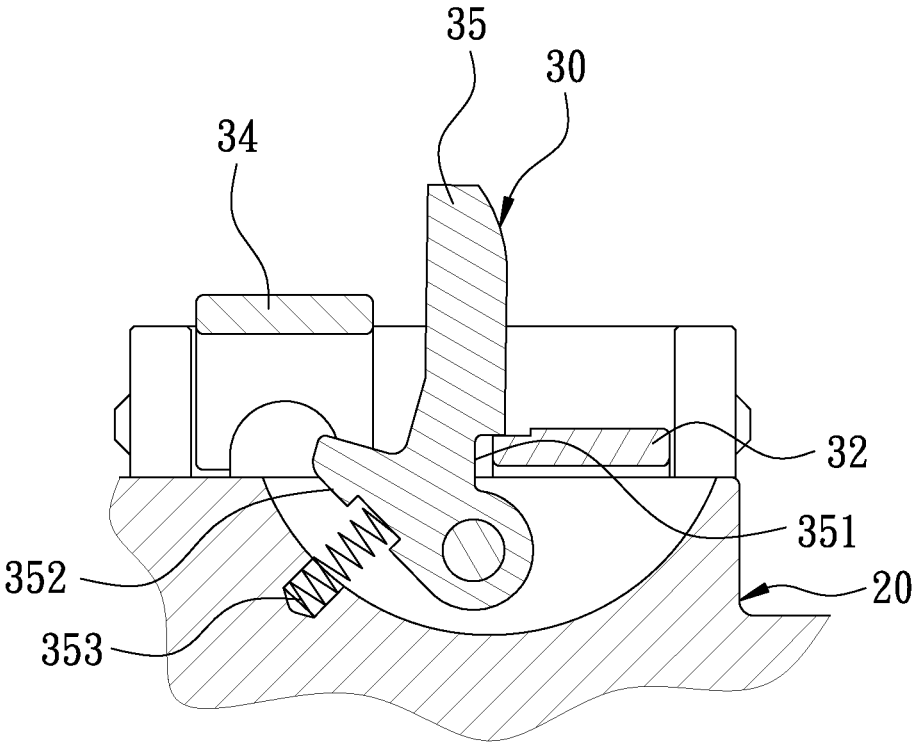
FIG. 14 is a partial cross-sectional view of the pneumatic packaging apparatus in a using condition in the present invention, illustrating that an elastic restraining member is engaged with the first press key.

Furthermore, referring to FIG. 14, another feature of this invention is the elastic restraining member 35 set between the first press key 32 and the second press key 34. The elastic restraining member 35 is formed with the protruding block 352 connected with the spring 353 that is connected with the valve seat 20, letting the elastic restraining member 35 possess a prestress to sway bias toward the first press key 32. Therefore, when the first press key 32 is pressed down, the elastic restraining member 35 will be actuated to sway bias toward the first press key 32 and have its recessed groove 351 engaged with the first press key 32, keeping the first press key 32 in a pressed-down condition. Thus, it is unnecessary for a user to continue pressing the first press key 32 and the first valve body 31 can always be kept in an opened condition for successively supplying high pressure gas to drive the pneumatic motor 41 to operate, able to carry out operation with convenience. In addition, to disengage the first press key 32 from the elastic restraining member 35, simply press down the second press key 34 to let the second press key 34 press the protruding block 352 of the elastic restraining member 35 to actuate the restraining member 35 to move bias toward the second press key 34 and have its recessed groove 351 move away from the first press key 32 to disengage the first press key 32 from the elastic restraining member 35.

While the preferred embodiment of the invention has been described above, it will be recognized and understood that various modifications may be made therein and the appended claims are intended to cover all such modifications that may fall within the spirit and scope of the invention.

What is claimed is:

1. A pneumatic packaging apparatus comprising:

a fixed base provided with a base plate, said base plate formed with a front end and an opposite rear end, said base plate having a topside longitudinally bored with at least one insert hole, said insert hole having at least one roller pivotally set therein, said base plate of said fixed base having one side provided with a fixed block protruding up vertically;

a valve seat pivotally set at one side of said fixed block, said valve seat facing an rear end of said base plate and formed with a flow channel in an interior, said valve seat having an outer peripheral side bored with an air intake, a first valve hole and a second valve hole respectively communicating with said flow channel, said valve seat further having said outer peripheral side bored with a first exhaust hole communicating with said first valve hole, and a second exhaust hole communicating with said second valve hole;

a control unit having a first valve body received in said first valve hole, said first valve body connected with a first press key for controlling said first valve body to open to let said first valve hole communicate with said first exhaust hole, said control unit further provided with a second valve body positioned in said second valve hole, said second valve body connected with a second press key for controlling said second valve body to open to let said second valve hole communicate with said second exhaust hole;

a driving unit provided with a pneumatic motor fixed on said valve seat, said pneumatic motor connected with said first exhaust hole, said pneumatic motor having an output shaft provided thereon with a worm, said driving unit containing a driving shaft pivotally assembled on said valve seat, said driving shaft having a worm wheel mounted thereon, said worm wheel engaged with said worm, said driving shaft fixed thereon with a driving wheel, said driving wheel positioned on said roller;

a pressure cylinder unit firmly installed at one side of said fixed block, said pressure cylinder facing a front end of said base plate and consisting of a pressure cylinder body, said pressure cylinder body assembled therein with an elastic sealing pad, said pressure cylinder body formed with a first accommodating chamber and a second accommodating chamber, said pressure cylinder body having an outer circumferential side bored with a first insert hole communicating with said first accommodating chamber, said first insert hole communicating with said second exhaust hole, said pressure cylinder body further having said circumferential side bored with a second insert hole communicating with said second accommodating chamber; and a chuck unit having a press plate received in said second accommodating chamber, said press plate connected with a shaft rod, said shaft rod having another end passed out of said second insert hole and pivotally connected with a pair of connecting rods, said pair of connecting rods having their another ends respectively and pivotally connected with a clamping lever, said clamping lever having another end pivotally assembled with a fixed plate, said fixed plate secured with said fixed block of said fixed base, said clamping levers having their another ends respectively and oppositely cut with a clamping notch, said shaft rod fitted thereon with at least one spring, said spring having two ends respectively pushing against said press plate and an inner wall of said second accommodating chamber.

2. A pneumatic packaging apparatus as claimed in claim 1, wherein said roller is a column, and a pivot of said roller is perpendicular to the lengthwise side of said base plate.

3. A pneumatic packaging apparatus as claimed in claim 1, wherein said control unit has an elastic restraining member set between said first press key and said second press key, said elastic restraining member having one end pivotally connected with said valve seat and another end being a free end, said elastic restraining member having a peripheral side cut with a recessed groove corresponding with said first press key, said elastic restraining member having another peripheral side formed with a protruding block corresponding with said second press key, said protruding block connected with a spring, said spring having another end connected with said valve seat, so that said elastic restraining member can possess a prestress to sway bias toward said first press key.

4. A pneumatic packaging apparatus as claimed in claim 1, wherein said first valve body is provided with a support member fixed in said first valve hole and said support member is axially bored with a shaft hole formed with a flaring opening adjacent to one end of said flow channel, said support member having an outer circumferential side annularly disposed with an annular groove at a location corresponding with said first exhaust hole, said annular groove having a bottom wall bored with a plurality of through holes communicating with said shaft hole, a steel ball positioned at a location of said flaring opening, said steel ball connected with a spring, said spring having another end secured at an inner wall of said flow channel, a valve rod slidably received in said shaft hole, said valve rod having one end protruding out of said shaft hole and resisting against said first press key, said valve rod having another end pushing against said steel ball.

5. A pneumatic packaging apparatus as claimed in claim 1, wherein said second valve body is provided with a support member firmly set in said second valve hole, said support member axially bored with a shaft hole formed with a flaring opening adjacent to another end of said flow channel, said support member having an outer circumferential side annularly cut with an annular groove corresponding with said second exhaust hole, said annular groove having bottom wall bored with a plurality of through holes communicating with said shaft hole, a steel ball set at a location of said flaring opening, said steel ball connected with a spring, said spring having another end firmly fixed with an inner wall of said flow channel, a valve rod slidably received in said shaft hole, said valve rod having one end protruding out of said shaft hole and resisting against said second press key, said valve rod having another end pushing against said steel ball.

* * * * *